US009174776B1

(12) United States Patent
DeTolla

(10) Patent No.: US 9,174,776 B1
(45) Date of Patent: Nov. 3, 2015

(54) METHODS AND DEVICES FOR IMPROVED MATERIALS STORAGE

(71) Applicant: Andrew J. DeTolla, Westford, MA (US)

(72) Inventor: Andrew J. DeTolla, Westford, MA (US)

( * ) Notice: Subject to any disclaimer, the term of this patent is extended or adjusted under 35 U.S.C. 154(b) by 0 days.

(21) Appl. No.: 14/211,457

(22) Filed: Mar. 14, 2014

Related U.S. Application Data

(60) Provisional application No. 61/799,279, filed on Mar. 15, 2013.

(51) Int. Cl.
*B65D 39/16* (2006.01)
*B65D 43/02* (2006.01)

(52) U.S. Cl.
CPC ..... *B65D 43/02* (2013.01)

(58) Field of Classification Search
CPC .. B44D 3/137; B65D 45/32; B65D 2525/283; B65D 81/245
USPC ..... 215/231, 363, 355, 358, 364, 320, 317, 215/319; 220/579, 578, 224, 223, 222, 221, 220/217, 216, 233, 803, 804, 802, 801, 756, 220/260, 287, 760, 759, 212.5
See application file for complete search history.

(56) References Cited

U.S. PATENT DOCUMENTS

| | | | | |
|---|---|---|---|---|
| 2,096,358 | A | 10/1937 | Gautier | |
| 2,677,816 | A | 5/1954 | Quist | |
| 2,767,890 | A | 10/1956 | Carter | |
| 2,828,886 | A * | 4/1958 | Thomas | 220/579 |
| 3,164,289 | A | 1/1965 | Cocchiarella | |
| 3,781,942 | A | 1/1974 | Coleman | |
| 3,784,051 | A | 1/1974 | Shaw | |
| 3,804,635 | A | 4/1974 | Weber | |
| 3,924,774 | A | 12/1975 | Donnelly | |
| 3,987,941 | A | 10/1976 | Blessing | |
| 4,209,105 | A | 6/1980 | Dominique | |
| 4,471,892 | A | 9/1984 | Coleman | |
| 4,552,090 | A | 11/1985 | Coleman | |
| 4,723,674 | A | 2/1988 | Nunes | |
| 4,790,458 | A | 12/1988 | Moore | |
| 4,874,108 | A | 10/1989 | Valasek | |
| 5,037,009 | A | 8/1991 | Shea | |
| 5,117,998 | A | 6/1992 | Handzel | |
| 5,305,909 | A | 4/1994 | Merritt | |
| 5,361,933 | A | 11/1994 | Oster | |
| 5,402,908 | A | 4/1995 | Warden | |
| 5,626,266 | A | 5/1997 | Michelson | |
| 5,957,338 | A | 9/1999 | Lehmann | |
| 5,988,423 | A | 11/1999 | Auzureau | |
| 5,993,096 | A | 11/1999 | Martelli | |
| 6,290,105 | B1 | 9/2001 | Cosentino | |

(Continued)

*Primary Examiner* — Mickey Yu
*Assistant Examiner* — Allan Stevens
(74) *Attorney, Agent, or Firm* — Maura K. Moran

(57) ABSTRACT

A plug device is disclosed for snugly sealing material within a container. The plug device has a flexible, foldable, deformable plug body sized to be positioned within the container. The plug device also has a plug handle section with handles for facilitating insertion and removal of the plug body and for deforming the plug body out of an unfolded state. A first handle is attached to the plug body at both its beginning and end and along a radial axis of the plug body. A second handle, offset from the first handle, is also attached to the plug body at both its beginning and end and along the radial axis. The handles may be manipulated to deform the plug body out of an unfolded state. The manipulation, which may be twisting, squeezing, or using a tool, facilitates insertion of the plug body into the container and removal from the container.

12 Claims, 12 Drawing Sheets

(56) References Cited

U.S. PATENT DOCUMENTS

| | | | | |
|---|---|---|---|---|
| 6,675,991 | B2 | 1/2004 | Johnson | |
| 7,182,538 | B2 | 2/2007 | Grosso | |
| 7,494,025 | B2 | 2/2009 | Porter | |
| 8,662,342 | B1 | 3/2014 | DeTolla | |
| 2004/0238544 | A1 | 12/2004 | Miller | |
| 2009/0095776 | A1 | 4/2009 | Turner | |
| 2011/0114592 | A1 | 5/2011 | Garrison | |
| 2012/0031905 | A1 * | 2/2012 | Perez et al. | 220/304 |

* cited by examiner

METHODS AND DEVICES FOR IMPROVED MATERIALS STORAGE

CROSS-REFERENCE TO RELATED APPLICATION

This application claims the benefit of the filing date of U.S. Provisional Patent Application No. 61/799,279, filed Mar. 15, 2013, and at least in part of U.S. patent application Ser. No. 13/341,867, for Materials Storage Method and Device, filed Dec. 30, 2011, and now issued as U.S. Pat. No. 8,662,342, the entire disclosure of both of which is hereby incorporated by reference.

FIELD

The present invention relates to the field of materials storage and particularly to sealing paint and other surface coatings for later use.

BACKGROUND

This invention relates to methods and devices which facilitate short to long term storage, using the original container or another container, of a material, such as a liquid. The material may include but not be limited to any type of interior or exterior latex or oil based paint, stain or other interior or exterior surface coatings. Note: "paint" is a general term used in this document to refer to all of the types of surface coatings referenced above.

The price of premium paint cost in excess of $50 per gallon. Having a convenient and cost effective way to preserve paint freshness for short or long periods of time protects this investment. Storing partially filled containers of paint for medium to long periods of time causes evaporation, and as a result, a paint skin forms on the surface. The evaporation problem is greatly accelerated in warm outdoor conditions, where paint is often stored in a secondary container for short periods of time on a project basis. Evaporation results in paint becoming thick and chemically compromised. The paint may be too thick to reconstitute and must be discarded, resulting in a waste of money and further stress on landfills or other methods of waste disposal. For oil based coverings, the air in the container may cause the paint to become oxidized, resulting in a thick skin of the coating to form on the surface. This may also result in the paint becoming chemically compromised and thickened. In addition, the skin that forms on the surface of the paint and on the interior wall of the paint can may fragment and contaminate the remaining paint, forcing the remaining paint to be discarded.

Various devices have been proposed in the art such as transferring unused paint to a separate storage container or removing the metal lid and replacing it with a flexible lid with a spout and seal. In addition, other devices have been proposed in which the air has been vacuumed out of a storage container. However, vacuums may accelerate evaporation, and so may not be suitable for use in storing paint, where evaporation may degrade the quality of the remaining paint.

It is assumed that these devices are useful for their intended purpose, however, these devices do not offer a paint for short to long periods of time, whether or not they use the original product packaging, and in the case of the flexible or vacuumed lid, does not address the evaporation and oxidation issues from the air volume within the partially empty container.

One convenient and relatively inexpensive way to preserve materials in their container is described in U.S. Pat. No. 8,662,342, which has a plug device for a container with a plug handle and a flexible plug body with an exterior edge that conforms to the contours of the interior wall of the container. The plug body is inserted into the container and is positioned to the surface of the material within the chamber using the plug handle. The plug body exerts resistance pressure against the interior wall of the container. The resistance pressure releasably seals the material in the chamber. In certain embodiments, while the plug body is inserted into the container, the resistance pressure squeezes the material from at least a portion of the interior wall of the container down to a pool of the material in the chamber of the container.

In U.S. Pat. No. 8,662,342, disclosed and incorporated herein by reference above, the flexible plug body has a plurality of seals that conform to contours of an interior wall of the container and that simultaneously fit within the container and exert resistance pressure against the interior wall of the container when the plug device is inserted into the container. The plurality of seals has a primary seal and a lower seal that is located below the primary seal along the radial axis of the flexible plug body. The primary seal has a flexible tubular structure with an outwardly facing curved surface, and the lower seal covers a top surface of the material within the container when the plug device is inserted into the container. The lower seal operating in conjunction with the primary seal to improve the releasable sealing by extending outwardly from a center portion of the flexible plug body further than the primary seal when the plug device is not inserted into the container. The lower seal has a flexible outer edge extending outwardly from a center portion of the flexible plug body further than the primary seal when the plug device is not inserted into the container, and curls upwardly toward and against the primary seal and the interior wall of the container when the plug device is inserted into the container. The plug body also has a plug handle section extending to a free end and arranged to facilitate inserting the flexible plug body into the container to the top surface of the material within the container.

It is desirable to provide the plug device with a simple, easy to use plug handle section, which may be used to stabilize a plug body of the plug device and to improve inserting the flexible plug body into and removing it from a container.

SUMMARY

A plug device is disclosed for snugly sealing material within a container when the plug device is inserted into the container. The plug device may have a plug body that is sized to be positioned within the container for releasably sealing material into the container and for covering a top surface of the material. The plug body may have sufficient flexibility for folding the plug body.

The plug device also may have a plug handle section with a plurality of handles for deforming the plug body out of an unfolded state. The deformation of the plug body facilitates insertion of the plug body into the can and removal of the plug body from the can. The plurality of handles may have a first handle attached to the plug body at both its beginning and its end and along a radial axis of the plug body, and a second handle attached to the plug body at both its beginning and its end, along the radial axis of the plug body, and offset from the first handle. In one embodiment, the offset between the first handle and the second handle may be approximately 90 degrees.

In certain embodiments, the first handle may be a rope material and a first handle support structure midway along the rope material facilitates holding of the first handle. In a further embodiment, the first handle may have a double strand of the rope material. In still further embodiments, the handle support structure may have a sleeve to hold the double strand together. In still further embodiments, the plug body may have holes extending through and spaced along its circumference, and at least one of the first handle and the second handle may be secured to the plug body by sewing the rope material through at least one selected hole of the plug body.

In still further embodiments, a tool may be provided for facilitating insertion of the plug device into the container. The tool may have a length longer than the distance between a fully extended first handle and an unfolded plug body so that, when the tool is positioned between the first handle and the plug body, the tool provides tension to fold the plug body. In a further embodiment, the second handle may be collapsible to a surface of the plug body and may be positioned between the tool and the plug body to facilitate providing tension to fold the plug body.

In still further embodiments, the tool may have an upper grip attached to the top of the tool to receive the handle support structure. It may also have a lower stabilizer attached to the bottom of the tool to stabilize the tool at a location approximately centered on the plug body.

In certain embodiments, the plug handle section is formed at least in part of a squeezable material that allows a selected handle to deform and force the plug body out of the unfolded state when one portion of the selected handle is squeezed toward a second portion of the selected handle. In a further embodiment, the squeezable material may be polyethylene. In another embodiment, the first handle and the second handle are formed of a squeezable material that allows at least one of the first handle and second handle to deform and force the plug body out of the unfolded state when the first handle is squeezed toward the second handle.

In other embodiments, a method is disclosed for releasably sealing a material into a container. In the method, a plug device may be sized to conform to contours of an interior wall of the container. A plug body may be provided on the plug device to cover a top surface of the material and to snugly seal the material within the container when the plug device is inserted into the container. The plug body may be provided flexibility to allow folding of the plug body.

Further, a plug handle section may be located on the plug device, in which a first handle may be attached to the plug body at both its beginning and end and along a radial axis of the plug body, and a second handle may be attached to the plug body at both its beginning and end and along the radial axis of the plug body. The second handle may be offset from the first handle. In the method, the plug handle system may be manipulated to deform the plug body out of an unfolded state. The folded plug body may be inserted into the container and the plug body released to cover the top surface of the material and snugly seal the material within the container.

In certain embodiments, manipulating the plug handle system comprises twisting at least one of the first handle and the second handle to deform the plug body. In other embodiments, a tool may be provided that has a length that is longer than a distance between a fully extended first handle and an unfolded plug body; and the tool may be positioned between the first handle and the plug body to provide tension to fold the plug body.

In other embodiments, the first handle and the second handle may be formed of a semi-rigid material, and manipulating the plug handle system comprises squeezing at least one of the first handle and second handle to deform the plug body to facilitate inserting the plug device into the container. In other embodiments, manipulating the plug handle system further comprises squeezing at least one of the first handle and the second handle at two locations to deform the plug body out of its unfolded state. In other embodiments, the first handle may be squeezed toward the second handle to deform the plug body out of its unfolded state.

In other embodiments, a method is disclosed for releasably sealing a material into a container. In the method, a plug device may be sized to conform to contours of an interior wall of the container. A plug body may be provided on the plug device to cover a top surface of the material and to snugly seal the material within the container when the plug device is inserted into the container. The plug body may be provided flexibility to allow folding of the plug body.

Further, a plug handle section may be located on the plug device, in which a first handle may be attached to the plug body at both its beginning and end and along a radial axis of the plug body, and a second handle may be attached to the plug body at both its beginning and end and along the radial axis of the plug body. The second handle may be offset from the first handle. In the method, the plug handle system may be manipulated to deform the plug body out of an unfolded state. The folded plug body may then be removed from the container.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DETAILED DESCRIPTION

Figure 1:
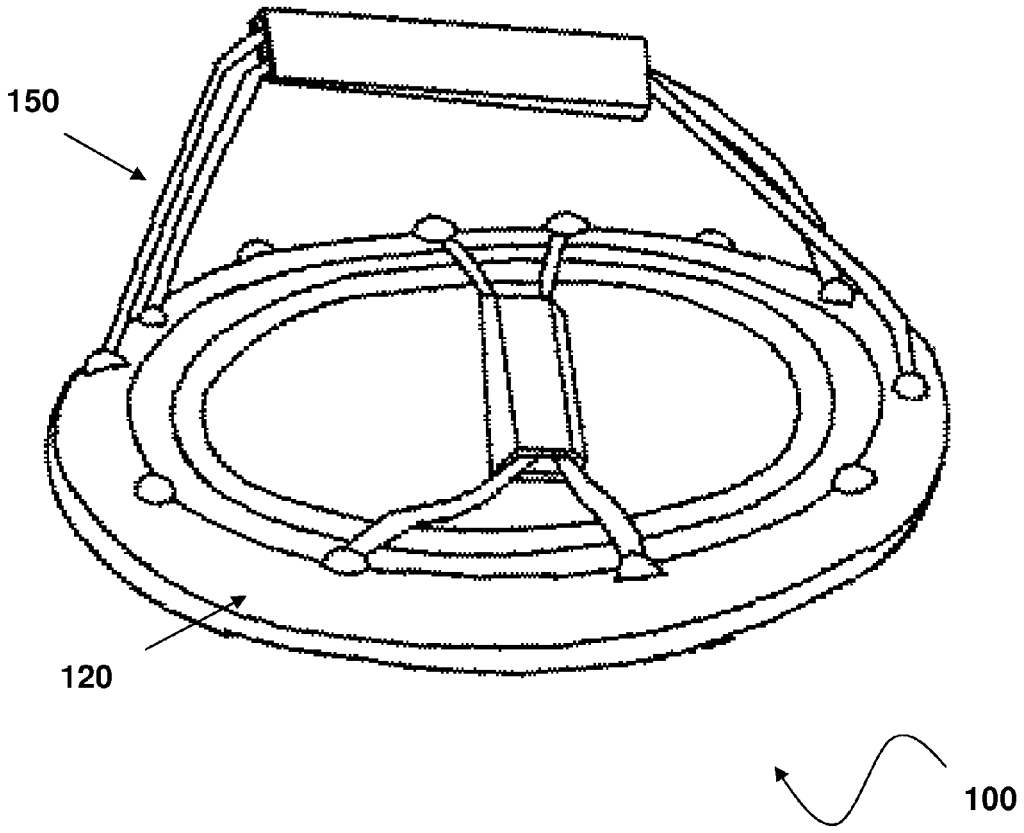
FIG. 1 is a perspective view of an exemplary material storage device 100, also known as a plug device 100.

A material storage device 100 according to the present invention will now be described in detail with reference to FIGS. 1 to 8 of the accompanying drawings. The material storage device 100, also known as a plug device 100, may be used to plug a container of a material such as but not limited to paint.

The plug device 100 for snugly sealing material within a container when the plug device is inserted into the container may include a flexible plug body 120 and a plug handle section 150. The device 100 may be positioned within a materials container 50 such as a paint can 50 slightly above or touching the surface of the paint to seal the can after it has been opened and to prevent the paint surface from forming a skin which could contaminate the remaining stored paint. The plug body 120 is sized to be positioned within the container for releasably sealing material into the container and for covering a top surface of the material. The plug body may have sufficient flexibility for folding the plug body. Further, the plug body has a circular configuration, but it is to be understood that in other embodiments plug body 120 may be non-circular to accommodate the interior wall of a container with a non-circular cross-section.

The plug body 120 has a flexible membrane 420 joined to a seal system 410, and may have a diameter that is slightly larger than the diameter of the interior wall of the can. The plug body 120 exerts resistance pressure against the interior wall of the can. As the plug body 120 is pushed down into the can to the surface of the paint, the resistance pressure causes the membrane 420 and seal system 410 to scrape the paint on the interior surface of the can down into the body of the paint in the can, thus conserving paint and preventing any excess paint from forming a skin on the sides of the can which could contaminate the remaining stored paint. When the plug body 120 is positioned within the can slightly above or touching the surface of the paint, the membrane 420 and seal system 410 seals the can and removes the air between the paint surface and the bottom of the paint plug device surface, thus preventing the paint surface from forming a skin which may contaminate the remaining stored paint and preventing evaporation which may cause the paint to become thick and unusable.

As seen in FIGS. 1, 2, 4, 5, and 6, the seal system 410 has a lower seal 430 and triple tubing (which in this embodiment are O-Rings 412, 414, and 416). The tubing is sandwiched between the flexible membrane 420 and lower seal 430 to provide the expansion resistance and flexibility to easily insert and remove the device.

Figure 6:
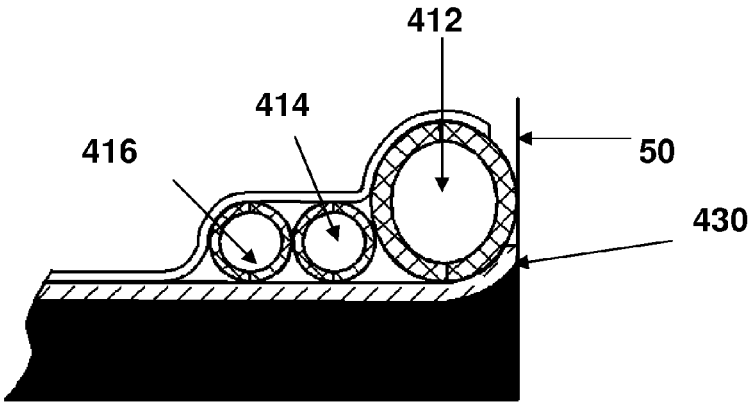
FIG. 6 is a sectional view of the seal system 500 shown in FIG. 5, as the plug body 120 is installed in a can 50.

The outer tube 412 (also known as the O-ring 412 and outer ring 412) and the lower seal 430 work together to provide a double seal. As shown in FIG. 6, the lower seal 430, when positioned inside the can 50, curves upward against the wall of the can 50. The outer tube 412 then presses against the lower seal 430, squeezing the lower seal 430 and pressing it further against the interior wall of the can 50. Therefore, the lower seal 430 is flexible enough to bend to facilitate getting the plug device 100 in and out of the can, and it is sized to be large enough to be caught between the outer tube 412 and the interior wall of the can 50. Thus, the plug device 120 provides two levels of seal and resistance ensuring all of the liquid product is returned back into the container 50 and ensuring a long lasting airtight seal which can be re-used over and over again.

Figure 2A:
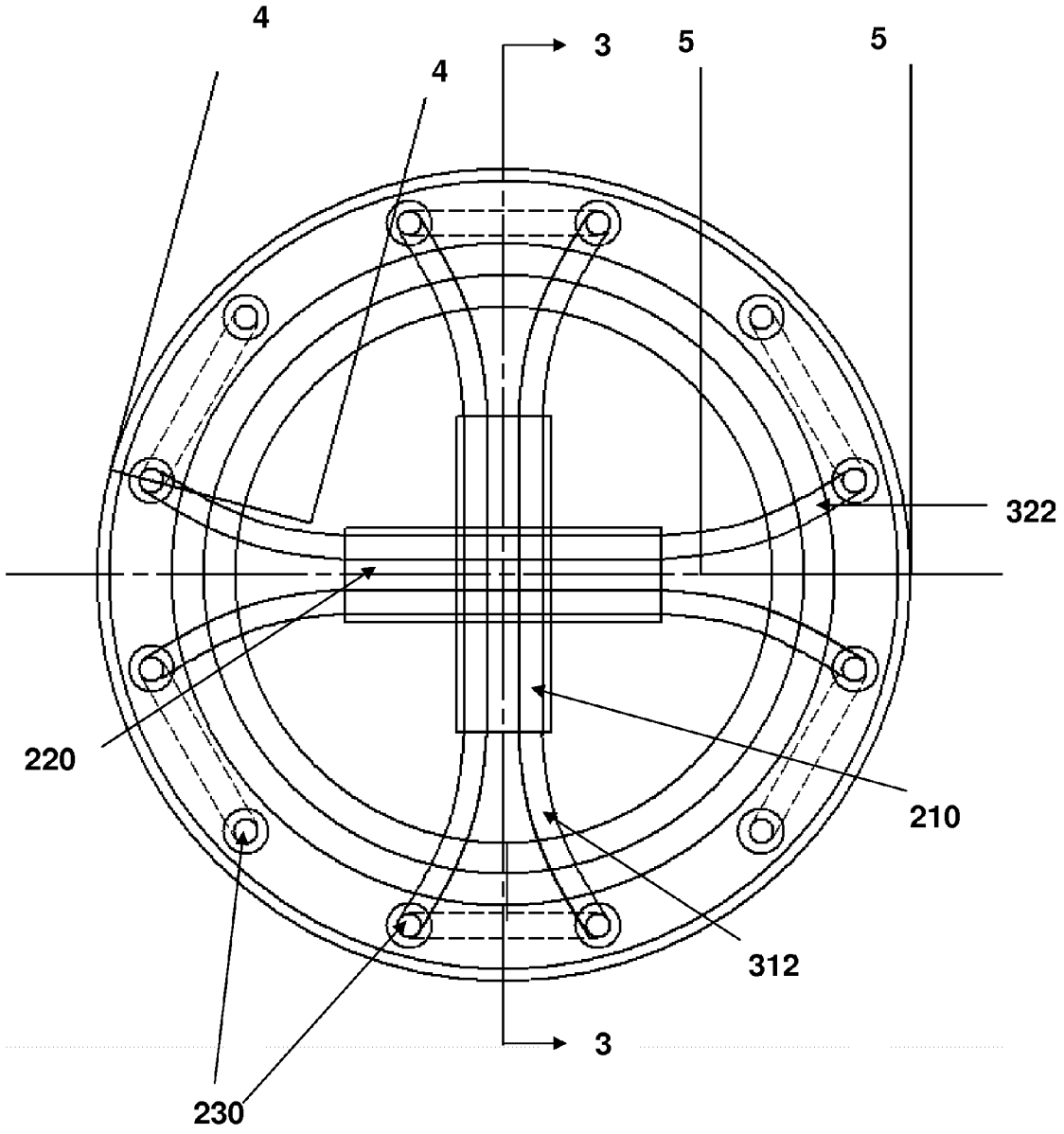
FIG. 2A is a top view of the plug device 100 as shown in FIG. 1.
Figure 2B:
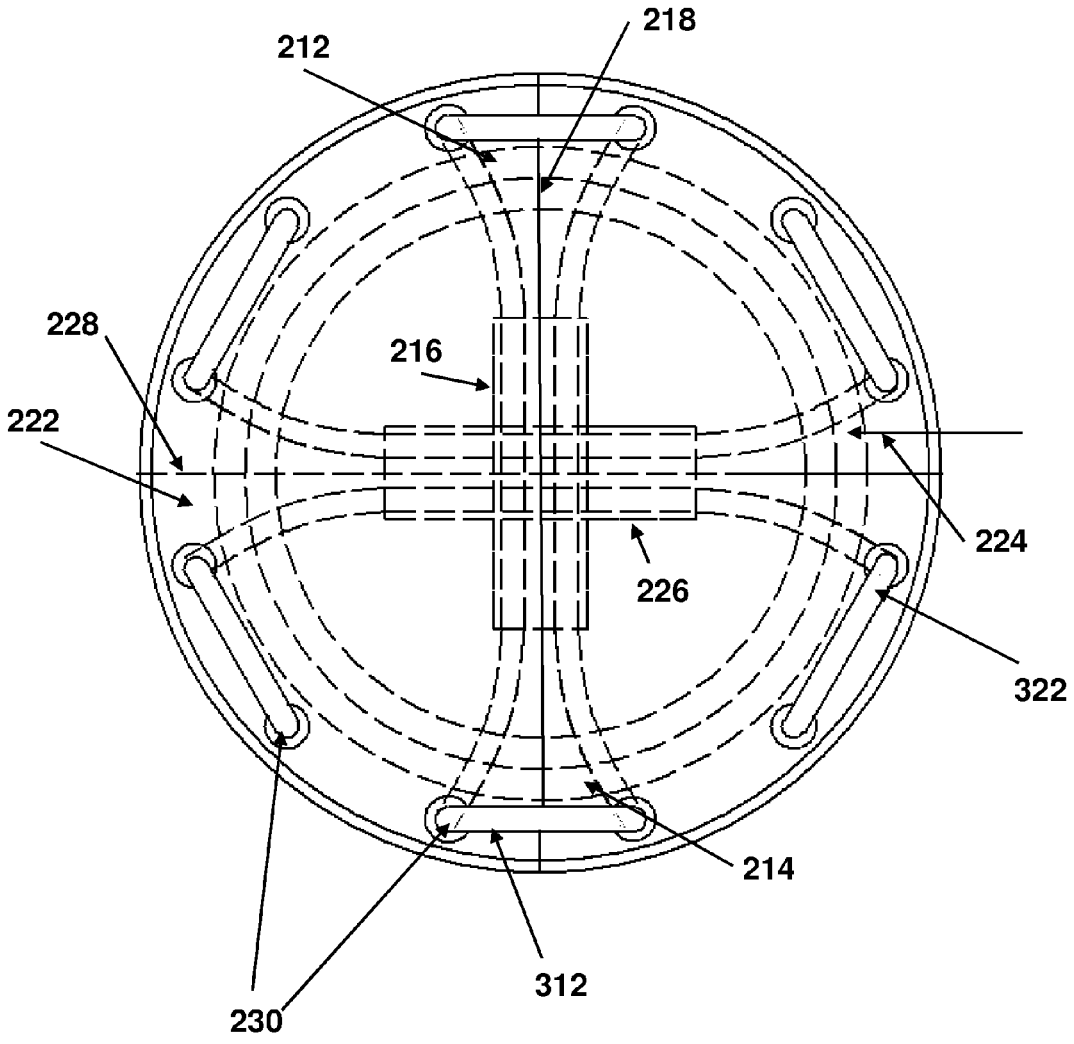
FIG. 2B is a bottom view of the plug device 100 as shown in FIG. 1.

The plug device 100 also has a plug handle section 150 with a plurality of handles for deforming the plug body out of an unfolded state and for facilitating insertion of the device 100 into a container and removing the device 100 from the container. In this embodiment, the plug handle section 150 has first and second handles 210, 220 that are attached to the plug body at both their beginnings 212, 222 and their ends 214, 224 at or near to the circumference of the plug body at opposite ends of diameters across the plug body 120. In the embodiment shown in FIGS. 1 to 8, the first handle beginning 212 and the first handle end 214 are each attached to the plug body at two locations near opposite ends of a first diameter 218; and the second handle beginning 222 and the second handle end 224 are each attached to the plug body at two locations near opposite ends of a second diameter 228. The portions 216, 226 of the first and second handles between their beginnings 212, 222 and ends 214, 224 are unattached to the plug body 120 except through their beginnings 212, 222 and their ends 214, 224. The first and second diameters are offset from each other. In the embodiment shown, the first and the second diameters 218, 228 are offset by 90 degrees, but any suitable offset is acceptable. The handles 210, 220 are formed of any suitable material. In the embodiment shown in FIGS. 1-9, they are formed of a rope material which is sewn through the outer ring 412 and lower seal 430. As shown in FIGS. 2A and 2B, the outer ring 412 and lower seal 430 have multiple holes 230 along their circumference through which the handle ropes 312, 322 may pass from one side of the plug body 120 to the other side to redistribute the stresses and load exerted on the plug device 100 by the plug handle section 150 as the plug device 100 is pulled out of the can. Thus, the handles are reinforced and ripping of the plug is prevented. The weaving of the rope through the plug can be seen in FIGS. 2A and 2B, in which the handle ropes 312, 322 are woven through the holes 230.

As can be seen in FIGS. 1-9, handles 210, 220 are also formed of a double length of the rope, with each strand of the handle offset from the other strand, again to provide strength to the handle, distribute pulling forces on the handle, and prevent inadvertent ripping. In addition, the handles 210, 220 may have handle support structures 314, 324, respectively, midway along the rope material to facilitate holding of the handles. In the current embodiment, the handle support structures 314, 324, are plastic sleeves 314, 324, to hold the double strands together, provide ergonomic comfort while the plug is being pulled out of the can, and, as disclosed below, to facilitate use of an insertion/removal tool.

Figure 3:
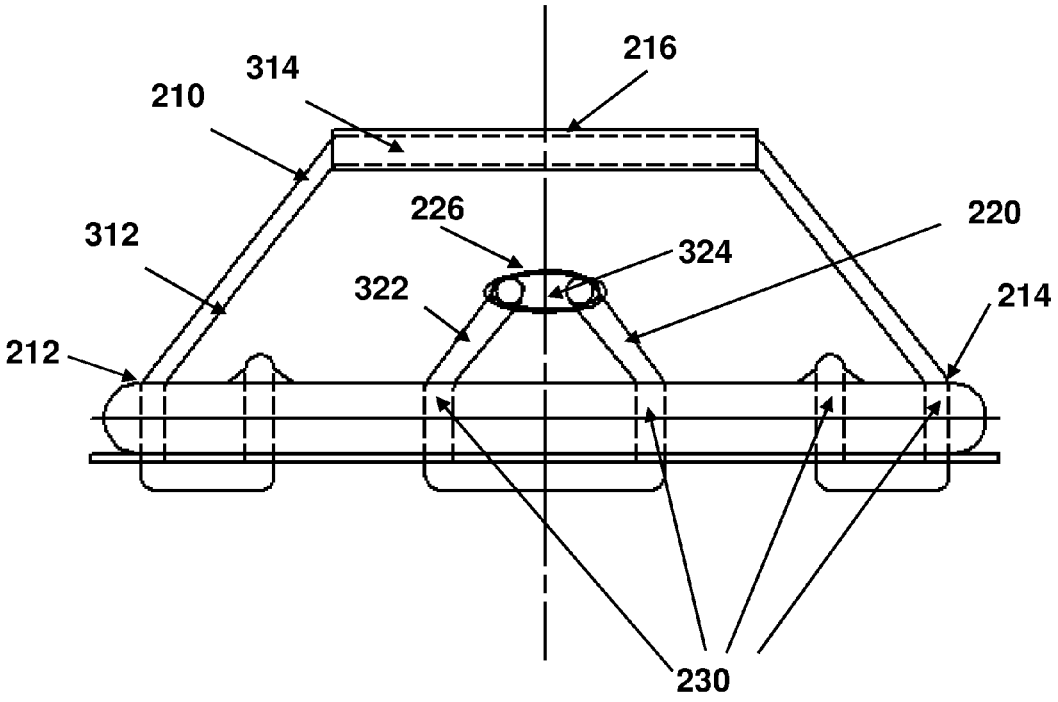
FIG. 3 is a sectional view of the plug device 100 taken along the lines 3-3 shown in FIG. 2A.
Figure 4:
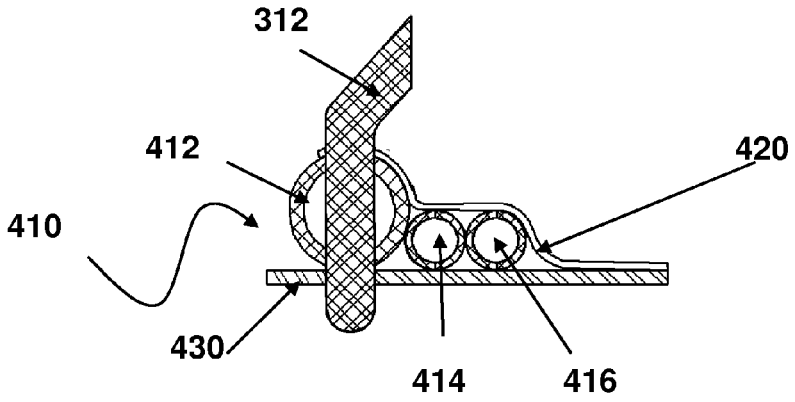
FIG. 4 is another sectional view of a portion of the plug body 120 shown in FIG. 1, now taken along the lines 4-4 shown in FIG. 2A.
Figure 5:
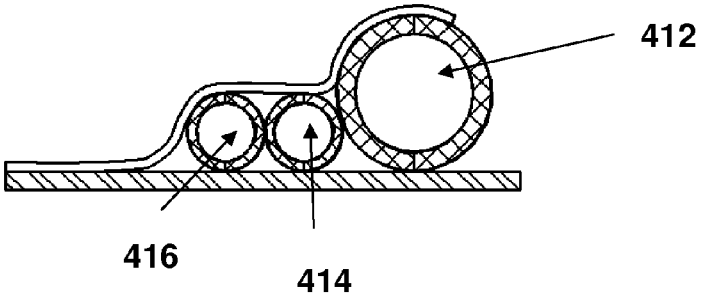
FIG. 5 is another sectional view of the portion of the plug body 120, now taken along the lines 5-5 shown in FIG. 2A.
Figure 7:
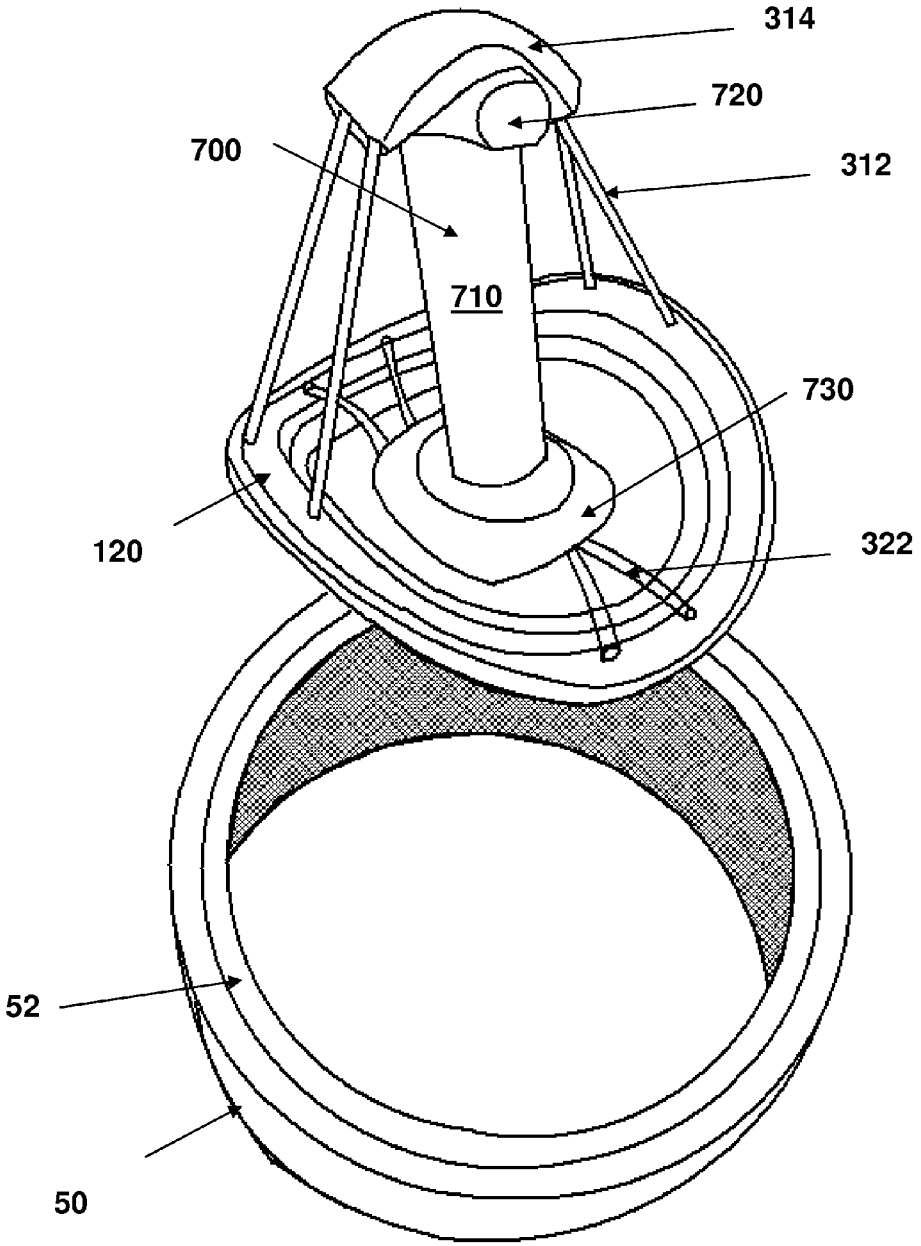
FIG. 7 is a perspective view of the plug device 100 as it is being installed into the can 50.

As shown in FIG. 3 and particularly in FIG. 7, the handle 220 is shorter than the handle 210. The second handle 220, thus also known as short handle 220, provides a good grip when removing the plug from a can. The first handle 210, thus also known as longer handle 210, provides stability when using a removal/insertion tool 700.

FIG. 7 shows a removal/insertion tool 700 in operation. The tool 700 makes it easy to compress, deform, or fold the seal to easily insert in the can and to remove the seal from the can. The seal may be installed or removed in seconds. The tool 700 has a long handle 710 that may be sized to have a length longer than the distance between a fully extended first handle 210 and an unfolded plug body so that, when the tool is positioned between the first handle and the plug body, the tool provides tension to fold the plug body. In the embodiment shown in FIG. 1 and FIG. 7, the second handle 220 may be collapsible to a surface of the plug body 120, and it may be positioned between the tool 700 and the plug body to facilitate providing tension to fold the plug body. In such case, the tool may have a length longer than the distance between the sleeves 324, 314 when the handle 220 is resting on the plug body 120 in its unfolded state and the handle 210 is extended up from the plug body to the furthest extent possible while the plug body 120 stay planar. The height of the long handle 710 is designed to secure the tool 700 snugly between the plug body 120 and the handle 210 and to force the plug body 120 into a folded position.

The tool 700 may have an upper grip 720, also known as the upper handle, attached to the long handle 710 to receive the upper sleeve 314 and to stabilize the tool 700 against the upper sleeve 314, and a lower stabilizer 730 attached to the long handle 710 to stabilize the tool 700 against the plug body 120 so that the tool stays approximately centered on the plug body 120. The tool 700 may be slipped between the sleeves 314, 324 to provide tension on the handle 210, thus causing the plug body 120 to compress and fold upwards toward upper handle 720, and the folded plug body 120 may more easily fit into the can 50 and removed from the can through the can's rim 52.

Figure 8:
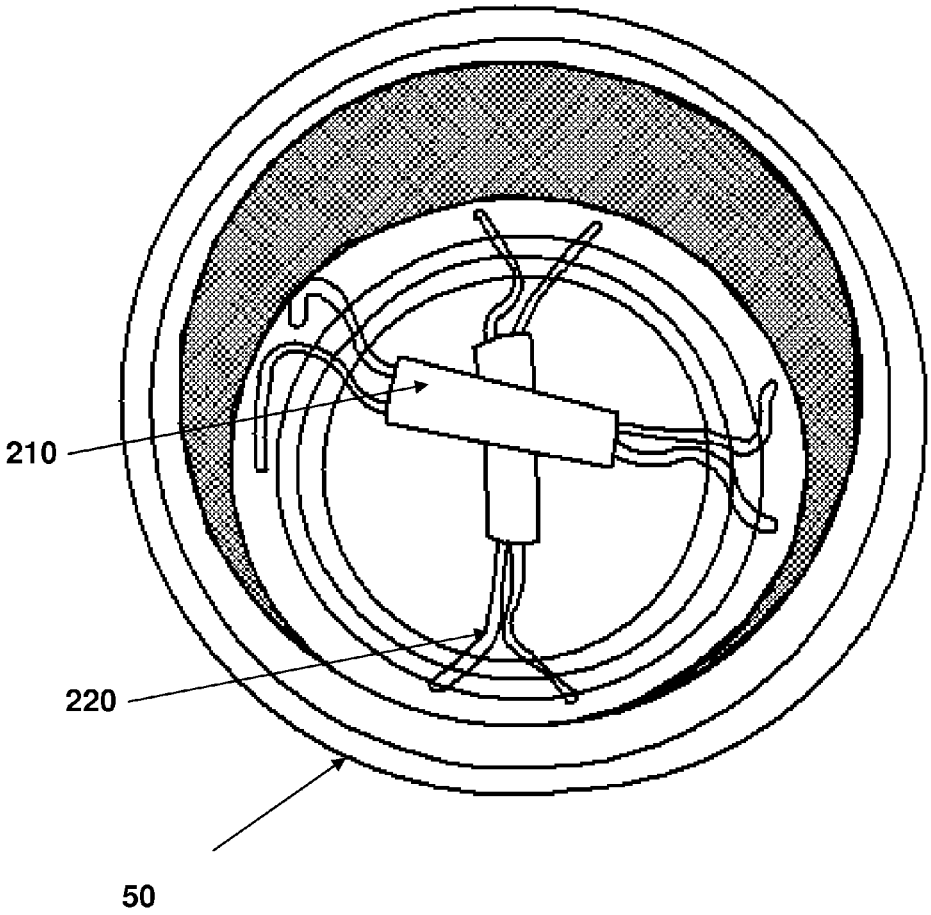
FIG. 8 is a top perspective view of the plug device 100 installed into the can 50.

FIG. 8 shows the plug device 100 installed in a can 50. The short handle 220 may be used to push the plug device 100 to the surface of the material so that the plug body 120 rests on or slightly above the surface of the material in the can 50.

The plug device may remain in the can and in use for extended periods of time (days, weeks, months). The plug device may be used to store the material in its original container packaging for short or long term use, or may be used to preserve materials in an external container for short term projects. The plug device 100 may be removed from the can 50 by pulling on the short handle 220. The handles 210, 220 may be twisted alone or in combination to deform the plug body out of its unfolded state. The attachment of handle 220 in two different locations on the plug body 120 reinforces the handle 220 and prevents ripping of the plug during its removal from the can 50. Further, the suppleness of the plug body 120 allows the plug body 120 to deform during its removal from the can 50 and thus allow it to slip out of the can 50. Instead of using twisting force on the handles 210, 220 to force the plug body out of its unfolded state, the tool 700 may be used to facilitate removal of the plug device 120. It may be slipped between the first handle 210 and the plug body, or between the sleeves 314, 324 to provide tension on the handle 210, thus causing the plug body 120 to compress and fold, thus facilitating the plug body's insertion into or removal from the can 50 through the can's rim 52.

After the removal of the plug device 100 from the can 50, the paint may be found to be in perfect condition, with no evaporation and no skin on the surface of the paint.

Another embodiment according to the present invention may be seen in material storage device 900, which will now be described in detail with reference to FIGS. 9 to 13 of the accompanying drawings. Device 900 has a flexible plug body 920 and a plug handle section 950. The plug body 920 has a lower seal 930 joined (for example, by gluing) to a sealing ring 910. The lower seal 930 may be made of vinyl, and it may be circular shaped. The plug body 920 has a circular configuration, but it is to be understood that in other embodiments the plug body may be non-circular to accommodate the interior wall of a container with a non-circular cross-section. The sealing ring 910 may be a polyethelyne circular shaped tube or O-ring to seal and provide support and rigidity to the lower seal 930, In this embodiment, the plug handle section 950 has two handles 960, 970. The first and second handles are attached to the plug body at or near the circumference of the plug body 920 at or near opposite ends of diameters across the plug body 920. In the embodiment shown in FIGS. 9 to 13, the first handle beginning 962 and the first handle end 964 are attached to the plug body at or near opposite ends of a first diameter 968; and the second handle beginning 972 and the second handle end 974 are attached to the plug body at or near opposite ends of a second diameter 978. The portions 966, 976 of the first and second handles between their beginnings 962, 972 and ends 964, 974 are unattached to the plug body 920 except through their beginnings 962, 972 and their ends 964, 974. Also as with the embodiment shown in FIGS. 1-8, the first and second diameters 968, 978 are offset from each other. As shown in FIG. 10, the diameters are offset by 90 degrees, but any suitable offset is acceptable. In the embodiment shown in FIGS. 9-13, the handles 960, 970 may be formed of a squeezable material that allows a selected handle to deform and force the plug body out of the unfolded state when one portion of the selected handle is squeezed toward a second portion of the selected handle. The handles may be formed at least in part of polyethelene, and, while other shapes may be suitable, in the embodiment shown in FIGS. 9-13, the handles 960, 970 may be tubes. Each end of each tube is joined (for example, by gluing) to the sealing ring 910 to form two tubular semicircles that may serve as insertion and extraction handles for the plug body 920.

Figure 9:
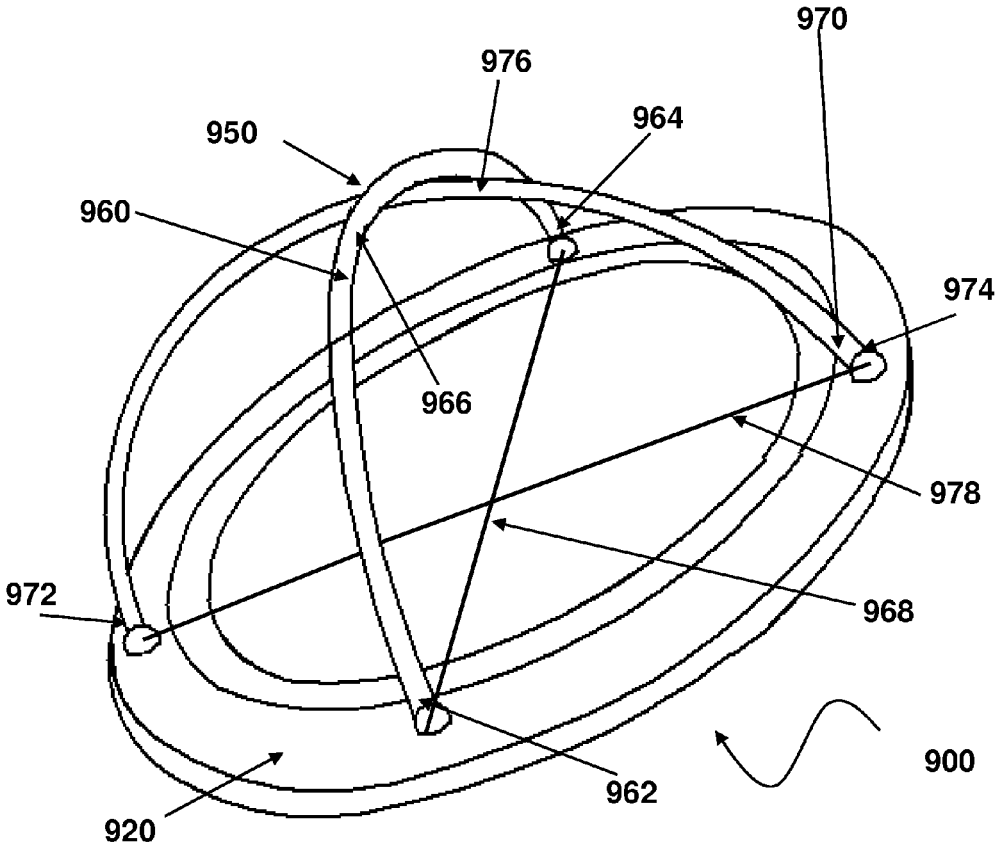
FIG. 9 is a perspective view of an another embodiment of a material storage device 900, also known as a plug device 900.
Figure 10:
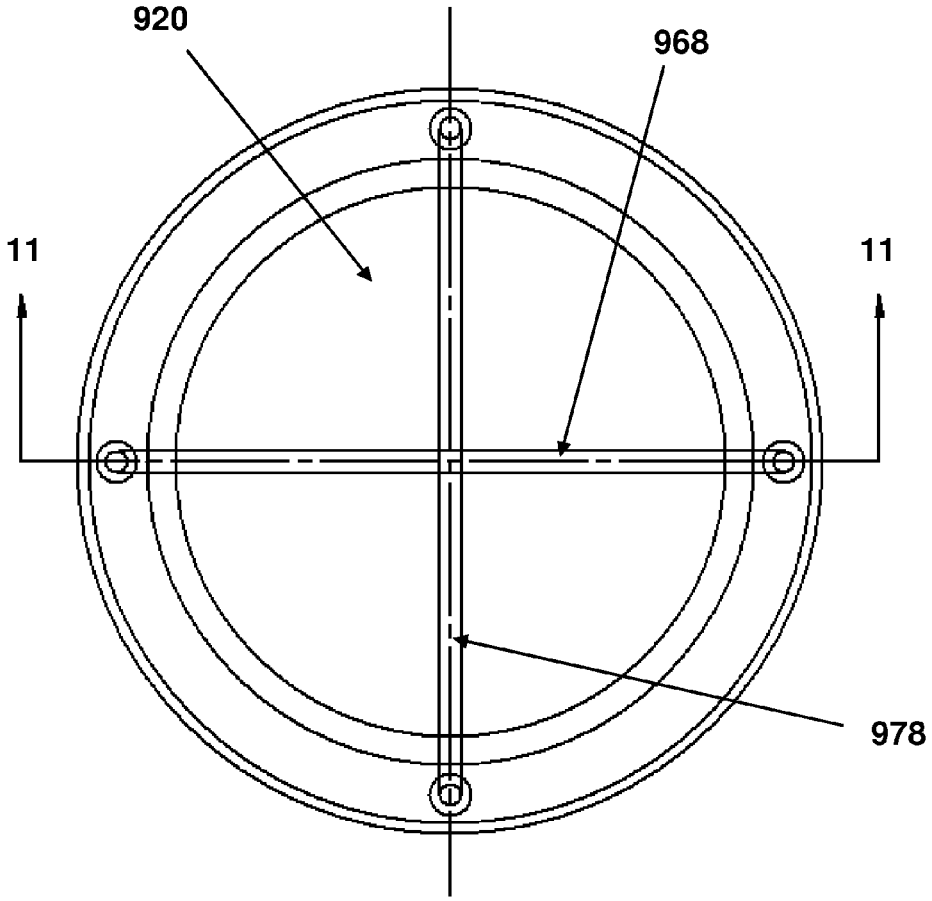
FIG. 10 is a top view of the plug device 900 as shown in FIG. 9.
Figure 11:
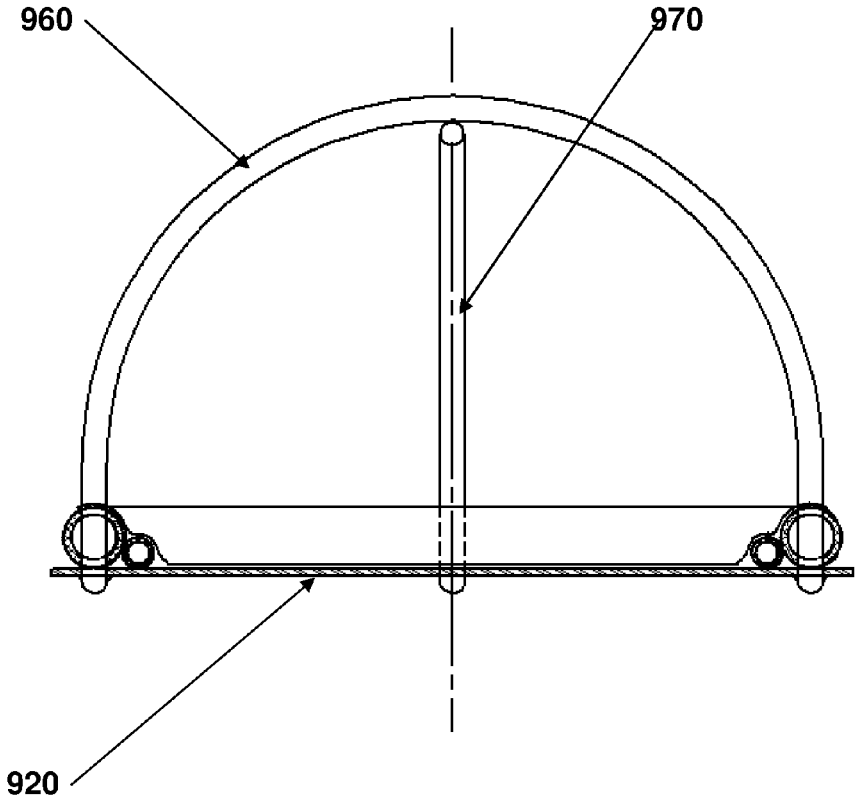
FIG. 11 is a sectional view of the plug device 900 taken along the lines 11-11 shown in FIG. 10.
Figure 12:
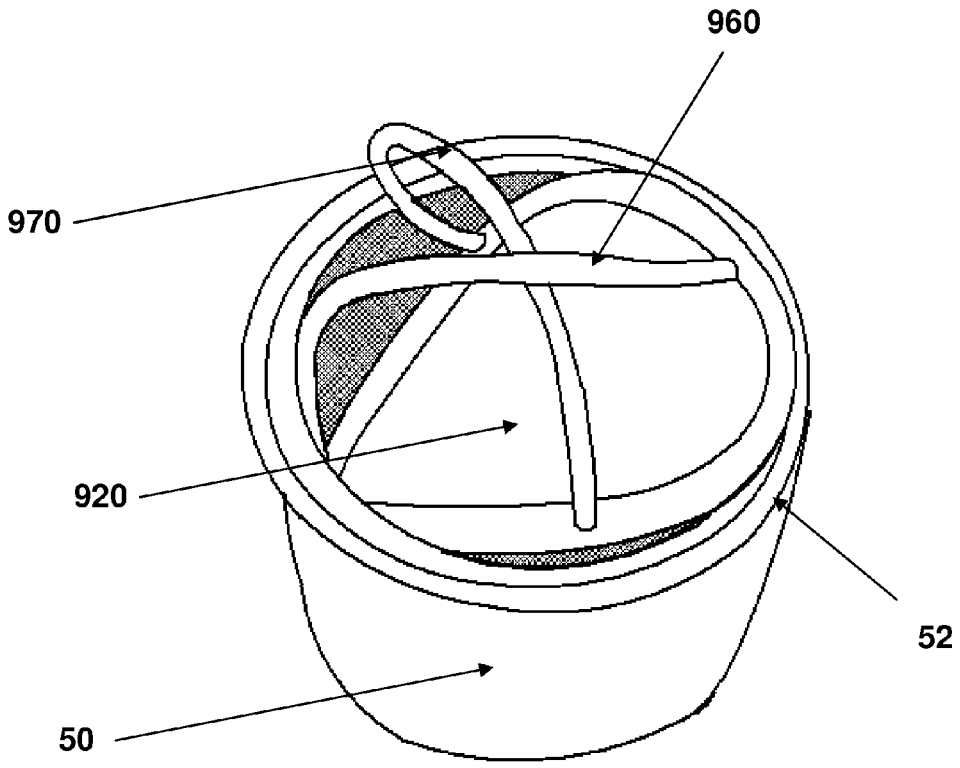
FIG. 12 is a perspective view of the plug device 900 as it is being installed into the can 50.

As shown in FIG. 9 and particularly in FIG. 11, the handle 970 may be shorter than the handle 960 so that the apex of the handle 970 may pass under the apex of the handle 960. As shown in FIG. 12, the handle 960, 970 may be squeezed, each alone or in combination, to deform the plug body 920 out of its planar shape so as to compress and fold the plug body 920 to allow it to more easily fit into the can 50 through the can's rim 52. The squeezable material may allow at least one of the handles to deform and force the plug body out of the unfolded state when the first handle is squeezed toward the second handle.

Figure 13:
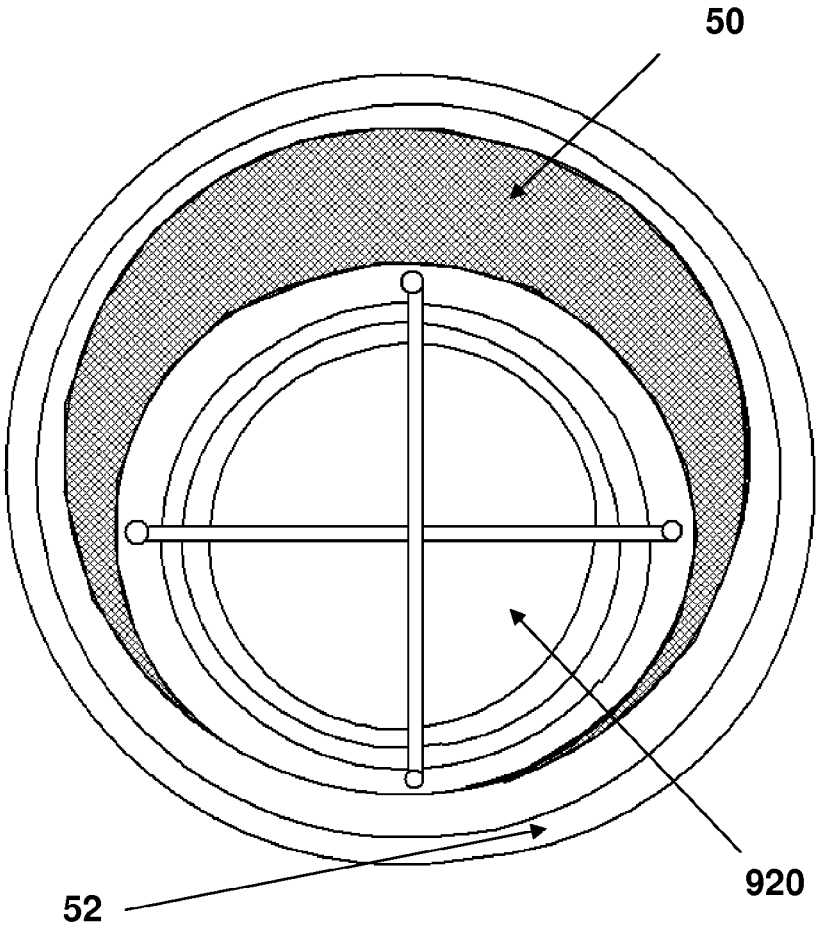
FIG. 13 is a top perspective view of the plug device 900 installed in the can 50 and positioned to cover the material within the can 50.

FIG. 13 shows the plug device 900 installed in a can 50. The handles 960, 970 may be squeezed, each alone or in combination, to push the plug device 900 to the surface of the material so that the plug body 920 rests on or slightly above the surface of the material in the can 50. A user may remove the plug device 900 from the can 50 by pulling up on the handles 960, 970, each alone or in combination, and squeezing them, each alone or in combination, so that the plug body 920 may be compressed and folded to allow it to more easily be pulled from the can 50 through the can's rim 52. The paint may be removed from the bottom of the plug body using a paint brush or paper towel, or the plug device 900 may be washed in soapy warm water using a sponge, cloth or paper towel. Formed of vinyl and polyethelene, the device is fully washable and submersible.

Advantages to the embodiment of plug device 900 is that its design is inexpensive to manufacture, flexible to use, and washable/submersible to allow for frequent re-usability.

It may be seen that the embodiments of the devices and methods for sealing paint cans disclosed here may be used to greatly extend the shelf life of partially used paint within the original packaging. Many features are described that may be included in storage plug devices to accommodate the best price performance based on the type of paint being stored and how long it is intended to be stored. For example, if a paint is more expensive or if it is intended that the paint be stored for longer periods of time, the user may select an embodiment of the device that has additional upper and lower seals, to ensure increased sealing performance. The unique paint container wall scraping feature may be incorporated into a device to avoid paint contamination and maximize the amount of paint preserved for future use. In addition, the disclosed devices and methods reduce environmental stress on landfills because paint will last much longer and may be available for use for a longer period of time. The disclosed features reduce the cost associated with safe disposal of paint material, because less paint is wasted.

One of skill in the art will appreciate that the above-described stages may be embodied in several ways. Although the disclosed components have been described above as being separate units, one of ordinary skill in the art will recognize that functionalities provided by one or more units may be combined. As one of ordinary skill in the art will appreciate, one or more of units may be optional and may be omitted from implementations in certain embodiments. In addition, while the embodiments above have been described with reference to storing paint for reuse, it is to be understood that the devices and methods described herein are not limited to storing paints. Instead, the embodiments described herein may be used to store any materials, such as any liquids or solids, where there is a need to provide secure sealing for short or longer periods.

The foregoing descriptions have been presented for purposes of illustration. It is not exhaustive and does not limit the invention to the precise forms or embodiments disclosed. Modifications and adaptations of the invention will be apparent to those skilled in the art from consideration of the specification and practice of the disclosed embodiments. For example, the described implementations may be implemented in a variety of materials, sizes and shapes, and be arranged differently than the figures illustrate. It is intended that the specification and examples be considered as exemplary only.

The invention claimed is:

1. A plug device for snugly and releasably sealing material within a container when the plug device is inserted into the container, the plug device comprising:

a plug body that is sized to be positioned within the container for releasably sealing material into the container and for covering a top surface of the material, wherein the plug body has sufficient flexibility for at least partially folding the plug body, and a plug handle section having a plurality of handles for holding the plug device, for manipulating the plug device into and out of the container, for facilitating insertion of the plug body into the container and removal of the plug body from the container, and for deforming the plug body out of an unfolded state, the plurality of handles comprising:

a first handle having a first handle beginning, a first handle end, and a first handle portion extending therebetween, wherein the first handle beginning and the first handle end are attached to the plug body at or near opposite ends of a first diameter across the plug body, and wherein the first handle portion is unattached to the plug body, except through the first handle beginning and the first handle end, and extends above the plug body along the first diameter; and a second handle having a second handle beginning, a second handle end, and a second handle portion extending therebetween, wherein the second handle beginning and the second handle end are attached to the plug body at opposite ends of the plug body at or near opposite ends of a second diameter across the plug body, and wherein the second handle portion is unattached to the plug body, except through the second handle beginning and the second handle end, and extends above the plug body along the second diameter; and wherein the second diameter is offset from the first diameter.

2. The plug device of claim 1, wherein the offset between the first diameter and the second diameter is approximately 90 degrees.

3. The plug device of claim 1, wherein the first handle comprises a rope material.

4. The plug device of claim 3, wherein the first handle comprises a double strand of a rope material.

5. The plug device of claim 4, wherein the first handle comprises a non-rigid material and further comprises a first handle support structure midway along the rope material to facilitate holding of the first handle; and wherein the first handle support structure comprises a sleeve to hold the double strand together.

6. The plug device of claim 4, wherein the plug body has holes extending through and spaced along a circumference of the plug body, and wherein at least one of the first handle and the second handle is secured to the plug body by sewing the rope material through at least one selected hole of the plug body.

7. The plug device of claim 3, further comprising a tool for facilitating insertion of the plug device into the container;

wherein the tool has a length longer than a distance between a fully extended first handle and an unfolded plug body so that, when the tool is positioned between the first handle and the plug body, the tool provides tension to fold the plug body.

8. The plug device of claim 7, wherein the second handle is collapsible to a surface of the plug body;

wherein the second handle is positioned between the tool and plug body to facilitate providing tension to fold the plug body.

9. The plug device of claim 7, wherein the tool comprises at least one of the following features:

an upper grip attached to a top of the tool to receive a first handle support structure midway along the rope material to facilitate holding of the first handle, and a lower stabilizer attached to a bottom of the tool to stabilize the tool at a location approximately centered on the plug body.

10. The plug device of claim 1, wherein the first handle and the second handle are formed of a squeezable material that allows the first handle and the second handle to deform and force the plug body out of the unfolded state when the first handle is squeezed toward the second handle.

11. The plug device of claim 10, wherein the squeezable material comprises polyethylene.

12. The plug device of claim 1, wherein the first handle and the second handle are formed of a squeezable material that allows at least one of the first handle and the second handle to deform and force the plug body out of the unfolded state when the first handle is squeezed toward the second handle.

* * * * *